United States Patent [19]

Tosswill

[11] Patent Number: 4,730,141

[45] Date of Patent: Mar. 8, 1988

[54] IMAGING TUBE HAVING A REFLECTIVE PHOTOCATHODE AND INTERNAL OPTICAL MEANS

[75] Inventor: Christopher H. Tosswill, Sturbridge, Mass.

[73] Assignee: Galileo Electro-Optics Corp., Sturbridge, Mass.

[21] Appl. No.: 842,298

[22] Filed: Mar. 21, 1986

[51] Int. Cl.[4] ..... H01J 29/45; H01J 31/48; H01J 31/49; H01J 43/18

[52] U.S. Cl. ..... 313/366; 313/371; 313/524; 313/527; 313/534; 250/333

[58] Field of Search ..... 313/366, 371, 367, 528, 313/524, 527; 250/213 VT, 330, 333

[56] References Cited

U.S. PATENT DOCUMENTS 4,608,519 8/1986 Tosswill ..... 313/528

*Primary Examiner*—David K. Moore
*Assistant Examiner*—K. Wieder

[57] ABSTRACT

An imaging tube particularly useful in providing a visible image corresponding to an incident infrared image in which a reflective photocathode is used to provide an electron image corresponding to the infrared image, and in which the incident image rays and the ultimate image rays move along different directions.

13 Claims, 1 Drawing Figure

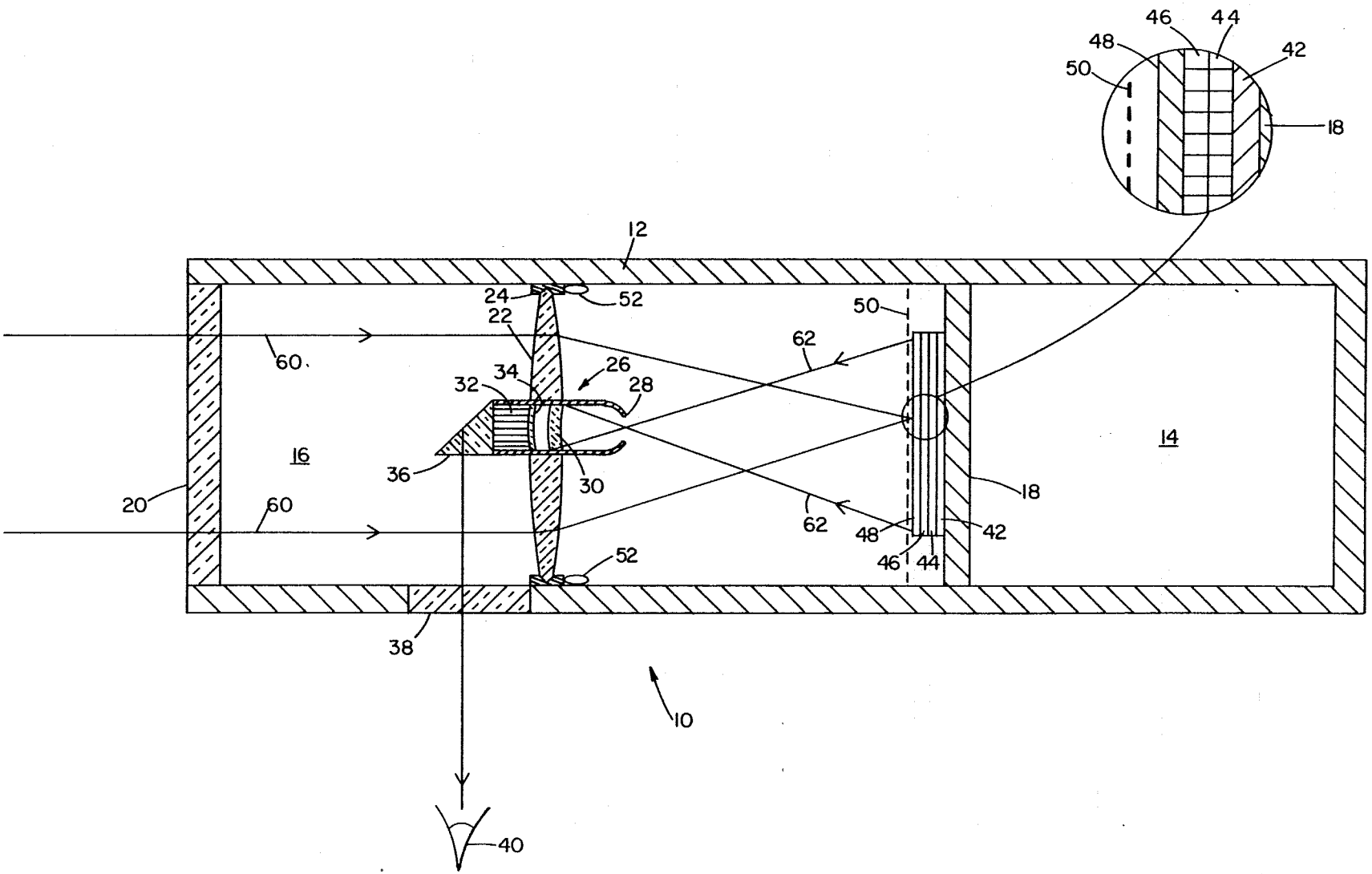
18
42
44
46
48
50
14
18
42
44
46
48
50
62
62
10
12
52
52
26
28
30
24
22
34
32
36
38
40
16
60
60
20

IMAGING TUBE HAVING A REFLECTIVE PHOTOCATHODE AND INTERNAL OPTICAL MEANS

FIELD OF THE INVENTION

This invention relates to imaging tubes employing reflective photocathodes.

BACKGROUND OF THE INVENTION

Imaging tubes using transmissive photocathodes are well known in the art. Also well-known are optical devices such as telescopes which make use of lens systems in which a small central portion of an optical element is functionally different from the portions of the element around it. Reflective photocathodes are known in vacuum photocells and photomultipliers. Convergent electrostatic electron lenses are known in, e.g., night vision image tubes.

SUMMARY OF THE INVENTION

I have discovered that an imaging tube especially useful in imaging infrared light sources in the range of wavelengths of 5 to 15 microns may be provided by introducing onto a reflective photocathode, from a centrally optically discontinuous optical element, rays of light, and then reflecting them back through the central portion of the optical element.

In a preferred embodiment, the optically discontinuous optical element is a lens having mounted centrally thereof an optical unit including an electron lens, a concavoconvex microchannel plate, a fiber optic correction cylinder, and a prism.

DESCRIPTION OF THE PREFERRED EMBODIMENT

The preferred embodiment, shown in the drawing, has the structure and mode of operation now discussed.

DRAWING

The drawing is a vertical sectional view, somewhat diagrammatical, and with a small portion shown enlarged, through the preferred embodiment.

STRUCTURE

There is shown in the drawing, indicated generally at 10, an imaging tube according to the invention.

The tube 10 includes a metal housing 12 surrounding a cryogenic portion 14 and a vacuum-tight imaging portion 16, the two being separated by integral heat-conducting metal wall 18. Portion 16 is closed in a vacuum-tight way by means of infrared ("IR")-transmissive window 20.

Mounted in housing 12 is optical lens 22, which is secured in housing 12 by means of ring 24 therearound.

Extending through lens 22 is an optical unit indicated generally at 26 and which includes electron lens 28 (with a resolution of 3 microns, and a minification ratio of 4:1), concavoconvex microchannel plate ("MCP") 30 (with channels on 10 micron centers), fiber optic bundle 32 of the general character disclosed in my U.S. Pat. No. 4,202,599, "Nonuniform Imaging", granted May 13, 1980, phosphor layer 34 (with proximity focus between MCP 32 and phosphor screen 34 of 3 micron resolution), and prism 36. Phosphor layer 34 and fiber optic bundle 32 are, toward microchannel plate 30, provided with spherical surfaces parallel with the surface toward them of the microchannel plate, phosphor layer 34 being thinly coated on fiber optic bundle 32 (with fibers on 5 micron centers) and being spaced from microchannel plate 30.

Window 38 transmissive to visible light is provided in housing 12 for viewing by eye 40. Infrared radiation thus enters imaging tube 10 through window 20 along a first axis, and visible light leaves imaging tube 10 through window 38 along a second axis that makes an angle of 90° with the first. The angle between the two is thus less than 180°, so that the light to be viewed is not directed back to the source of light being imaged.

Coated on wall 18 in imaging portion 16 is a continuous electrode 42 which carries on it a multiplicity of separate semiconductor phototransistor elements (indicated collectively at 44), as a mosaic. The elements 44 are about 75 microns square, and spaced apart with gaps of about 5 microns. Each semiconductor element carries on its face away from continuous electrode 42 an electrode 46 in contact only with its respective semiconductor element of the mosaic. Overlying the electrodes 46 is photocathode 48. Extending across portion 16 adjacent photocathode 48 is mesh grid 50. Mounted in portion 16 adjacent ring 24 is emission source 52, of wavelength of 850 nanometers.

OPERATION

In operation, infrared radiation 60, 10 microns in wave length and defining an image, enters tube 10 through window 20. The image is focused by lens 22 on the semi-conductor-electrodes-photocathode assembly 42, 44, 46, 48. Impact of rays of 10-micron infrared on particular semiconductor transistor elements 44 causes them to go to a negative 100 millivolt potential. At the same time, source 52 continuously supplies to photocathode 48 radiation at an emission wavelength of 850 nanometers; photocathode 48 has a photoemissive threshold of 900 nanometers, so that the radiation from source 52 causes photocathode 48 to emit photoelectrons 60 at a kinetic energy of about 80 millivolts. The potential on mesh grid 50 is minus 125 millivolts, so that an electron at a potential energy of 80 millivolts is unable to go through it. However, where an area of photocathode 48 is in contact with an electrode element 46 which is in contact with a semiconductor element 44 which has been exposed to the IR, that area of photocathode 48 has its potential reduced to minus 100 millivolts, making the voltage drop between it and grid 50 only 25 millivolts, enabling electrons from that area of photocathode 48 to penetrate the grid, in a patterning corresponding with the patterning of the IR beam incident on the tube.

Electrons 62 thus leaving photocathode 48 are focused by electron lens 28 onto the concavo surface of microchannel plate 30, in which the signal is amplified, and whence it goes through a vacuum gap onto phosphor layer 34, coated on the concavo surface of fiber optic bundle 32, the phosphor converting the electrons to visible light, which is turned by prism 36 to be viewed through window 38 as at 40. Distortion is modified by fiber optic bundle 32.

Use of a reflective photocathode provides many advantages. Temperature and electrical potential of the photocathode may be easily controlled. Cooling may be direct and efficient.

OTHER EMBODIMENTS

The optical element employed may be, instead of an optical lens, an optical mirror, for example at 45° to incident radiation focused on it by an optical lens to reflect it onto the photocathode. The mirror may be segmented to increase resistance along the mirror and prevent distortion of the electronic or electrostatic lens field.

The semiconductor elements in mosaic may be photoconductive, photovoltaic, or MIS elements. Alternatively, an electron beam may be used to produce a varying potential in the photocathode. The radiation to the photocathode to cause it to release electrons may be intermittent or continuous.

Other embodiments are within the scope of the following claims:

I claim:

1. An imaging tube for imaging light energy comprising a housing, a first window, a second window, a reflective photocathode emitting electrons in response to light energy, a conversion element for converting electrons to light energy, and an optical element, said first window and said second window being mounted in said housing to define therewith a vacuum-tight zone and to transmit therethrough respectively a first set and a second set of rays of light energy, said first set being said light energy to be imaged, said first window being arranged to transmit said first set along a first axis, said second window being arranged to transmit said second set along a second axis, said first axis intersecting said second axis at an angle of less than 180°, said conversion element being mounted to receive said electrons and to provide said second set, said optical element being mounted in said housing and including a centrally discontinuous portion, said optical element being oriented with respect to said first window and said photocathode so that said first set is directed by said optical element onto said photocathode, and at least one of said electrons and said second set is directed through said centrally discontinuous portion.

2. The image tube of claim 1 in which said optical element is an optical lens.

3. The image tube of claim 2 in which an optical unit is mounted in said centrally discontinuous portion.

4. The image tube of claim 3 in which said optical unit comprises a minifying electronic lens, a phosphor screen, and a concavoconvex microchannel plate.

5. The image tube of claim 4 in which said optical unit comprises also a distortion-modifying fiber optic bundle.

6. The image tube of claim 5 in which said optical unit comprises also a prism.

7. The image tube of claim 1 in which said angles are 90°.

8. The image tube of claim 1 in which said photocathode is in laminated relationship with a multiplicity of semiconductor elements adapted each to shift in its voltage on its surface toward said photocathode upon impingement thereon of said first set.

9. The image tube of claim 1 in which said first set is in the infrared range.

10. The image tube of claim 9 in which said first set has a wave length of 10 microns.

11. The image tube of claim 8 which includes a grid between said photocathode and said optical element.

12. The image tube of claim 11 which includes also a source of radiation illuminating said photocathode.

13. The image tube of claim 11 in which electrons released from said photocathode owing to said source of radiation have energy sufficient to pass through said grid only at portions of said photocathode in contact with said semiconductor elements impinged on by rays of said first set.

* * * * *